US012765737B2

(12) United States Patent
Sun et al.

(10) Patent No.: US 12,765,737 B2
(45) Date of Patent: Oct. 20, 2026

(54) LIFTING DEVICE AND CLEANING APPARATUS

(71) Applicant: SHENZHEN SILVER STAR INTELLIGENT GROUP CO., LTD., Shenzhen (CN)

(72) Inventors: Huajun Sun, Shenzhen (CN); Lirong Ye, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 555 days.

(21) Appl. No.: 18/227,724

(22) Filed: Jul. 28, 2023

(65) Prior Publication Data

US 2024/0148212 A1 May 9, 2024

(30) Foreign Application Priority Data

Nov. 4, 2022 (CN) ..... 202211378109.X

(51) Int. Cl.

| | |
|---|---|
| ***A47L 11/40*** | (2006.01) |
| ***A47L 11/282*** | (2006.01) |
| *A46B 7/04* | (2006.01) |

(52) U.S. Cl.

CPC ..... *A47L 11/4055* (2013.01); *A47L 11/282* (2013.01); *A46B 7/04* (2013.01); *A47L 2201/06* (2013.01)

(58) Field of Classification Search

CPC ..... A47L 11/282; A47L 11/30; A47L 11/40
See application file for complete search history.

(56) References Cited

U.S. PATENT DOCUMENTS 5,924,167 A * 7/1999 Wright ..... A47L 13/26 15/373
2021/0030229 A1* 2/2021 Jang ..... A47L 23/26
(Continued)

FOREIGN PATENT DOCUMENTS

CN 1140117 A 1/1997
CN 113749574 A 12/2021
(Continued)

OTHER PUBLICATIONS

International Search Report for International Application No. PCT/CN2023/096943; Mailing Date, Oct. 24, 2023, 6 pages.
(Continued)

*Primary Examiner* — Michael D Jennings
(74) *Attorney, Agent, or Firm* — CANTOR COLBURN LLP

(57) ABSTRACT

The present application discloses the lifting device including: a drive motor, a rotating shaft, a transmission assembly, and a traction member; the rotating shaft includes a mounting portion and a lifting drive portion connected to the mounting portion; the transmission assembly is respectively connected to an output end of the drive motor and the rotating shaft; the traction member is threaded to the lifting drive portion; when the rotating shaft is rotated in a first rotation direction driven by the drive motor, the lifting drive portion rotates relative to the traction member and moves in a direction that approaches the mounting portion; and when the rotating shaft is rotated in a second rotation direction opposite to the first rotation direction driven by the drive motor, the lifting drive portion rotates relative to the traction member and moves in a direction away from the mounting portion.

20 Claims, 9 Drawing Sheets

(56) References Cited

U.S. PATENT DOCUMENTS

| | | | | |
|---|---|---|---|---|
| 2021/0030246 | A1* | 2/2021 | Jang | A47L 11/4013 |
| 2022/0248933 | A1* | 8/2022 | Zhang | A47L 11/4038 |
| 2024/0016356 | A1* | 1/2024 | Ding | A47L 11/4088 |

FOREIGN PATENT DOCUMENTS

| | | | |
|---|---|---|---|
| CN | 114010117 | A | 2/2022 |
| CN | 114831546 | A | 8/2022 |
| CN | 217645157 | U | 10/2022 |
| WO | 2022213445 | A1 | 10/2022 |

OTHER PUBLICATIONS

Written Opinion for International Application No. PCT/CN2023/096943; Mailing Date, Oct. 24, 2023, 7 pages.
Extended European Search Reporting for EP Application No. 23191069.6; Issue Date, Jun. 24, 2024.

* cited by examiner

LIFTING DEVICE AND CLEANING APPARATUS

CROSS REFERENCE TO RELATED APPLICATION

The present application claimed priority of Chinese Patent Application, with Application No. 202211378109.X, filed on Nov. 4, 2022; the content of which is incorporated herein by reference.

TECHNICAL FIELD

The present application relates to the technical field of cleaning apparatuses, and more particularly to a lifting device and a cleaning apparatus.

BACKGROUND

With the improvement of living standards, cleaning apparatus with cleaning function is more and more favored by people because of its advantages of convenient cleaning, time-saving and labor-saving.

In related technologies, a cleaning apparatus has been proposed, the cleaning apparatus is equipped with two drivers, one driver is used to drive the cleaning component to rotate for mopping, and the other one is used to drive the cleaning component to lift, in order to lift the cleaning components to avoid bumps or contamination of carpets and other items when the cleaning apparatus passes by an uneven ground, or when the cleaning apparatus passes by a road where carpets and other items are placed. Although the exemplary technology can effectively improve the practicality of the cleaning apparatus, the volume of the cleaning apparatus is increased due to the installation of two drivers, which is not conducive to the cleaning apparatus into a small space for cleaning operation, based on this, there is an urgent need for those skilled in the art to improve the cleaning apparatus.

SUMMARY

The present application provides a lifting device, which includes: a drive motor, a rotating shaft, a transmission assembly, and a traction member; the rotating shaft includes a mounting portion and a lifting drive portion connected to the mounting portion, and the mounting portion is configured for connecting with the cleaning component; the transmission assembly is respectively connected to an output end of the drive motor and the rotating shaft, to transfer a power of the drive motor to the rotating shaft; the traction member is threaded to the lifting drive portion; when the rotating shaft is rotated in a first rotation direction driven by the drive motor, the lifting drive portion rotates relative to the traction member and moves in a direction that approaches the mounting portion; and when the rotating shaft is rotated in a second rotation direction opposite to the first rotation direction driven by the drive motor, the lifting drive portion rotates relative to the traction member and moves in a direction away from the mounting portion.

The present application further provides a cleaning apparatus, which includes: a machine body, a lifting device, and a cleaning component; and the lifting device being mounted at a side of the machine body. The lifting device includes: a drive motor, a rotating shaft, a transmission assembly, and a traction member; the rotating shaft includes a mounting portion and a lifting drive portion connected to the mounting portion, and the mounting portion is configured for connecting with the cleaning component; the transmission assembly is respectively connected to an output end of the drive motor and the rotating shaft, to transfer a power of the drive motor to the rotating shaft; the traction member is threaded to the lifting drive portion; when the rotating shaft is rotated in a first rotation direction driven by the drive motor, the lifting drive portion rotates relative to the traction member and moves in a direction that approaches the mounting portion; and when the rotating shaft is rotated in a second rotation direction opposite to the first rotation direction driven by the drive motor, the lifting drive portion rotates relative to the traction member and moves in a direction away from the mounting portion; and the cleaning component is mounted on the mounting portion.

The present application further provides a cleaning system, which includes a cleaning apparatus, and the cleaning apparatus includes: a machine body, a lifting device, and a cleaning component; and the lifting device being mounted at a side of the machine body. The lifting device includes: a drive motor, a rotating shaft, a transmission assembly, and a traction member; the rotating shaft includes a mounting portion and a lifting drive portion connected to the mounting portion, and the mounting portion is configured for connecting with the cleaning component; the transmission assembly is respectively connected to an output end of the drive motor and the rotating shaft, to transfer a power of the drive motor to the rotating shaft; the traction member is threaded to the lifting drive portion; when the rotating shaft is rotated in a first rotation direction driven by the drive motor, the lifting drive portion rotates relative to the traction member and moves in a direction that approaches the mounting portion; and when the rotating shaft is rotated in a second rotation direction opposite to the first rotation direction driven by the drive motor, the lifting drive portion rotates relative to the traction member and moves in a direction away from the mounting portion; and the cleaning component is mounted on the mounting portion.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

Figure 1:
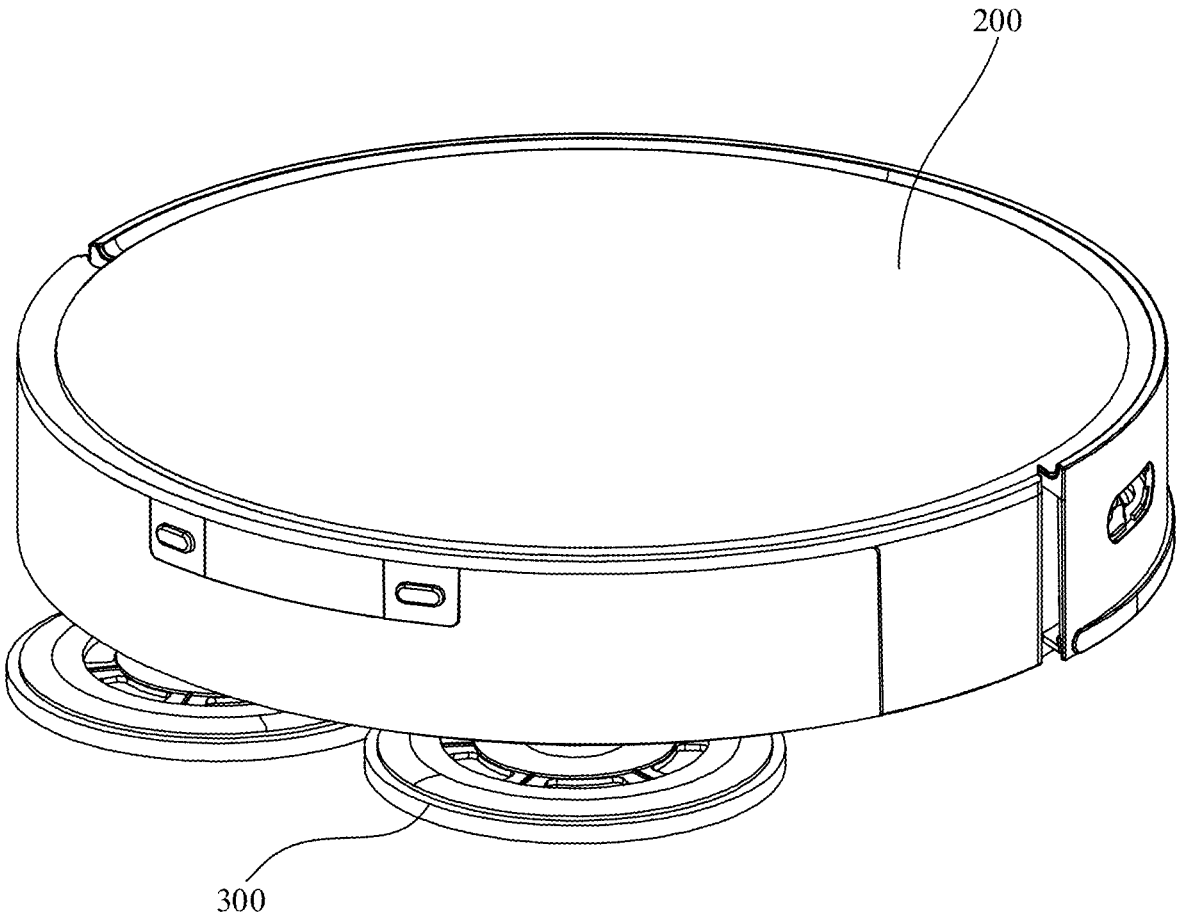
FIG. 1 is a structural schematic view of an embodiment of a cleaning apparatus of the present invention.

In the drawings, the reference signs are listed:

100—lifting device; 1—drive motor; 2—rotating shaft; 21—mounting portion; 22—lifting drive portion; 221—limiting structure; 222—mounting groove; 23—thread; 231—groove; 232—screw thread; 24—triggering portion; 25—first gear; 3—transmission assembly; 31—second gear; 4—traction member; 41—traction slider; 42—mounting housing; 421—guide groove; 5—switch; 51—button; 6—first elastic member; 7—second elastic member; 200—machine body; 300—cleaning component.

The realization of the object, functional features and advantages of the present application will be further described in conjunction with embodiments with reference to the accompanying drawings.

DETAILED DESCRIPTION OF EMBODIMENTS

The following is a clear and complete description of the technical solution in the embodiment of the present application in combination with the drawings attached to the embodiment of the present application. Obviously, the described embodiment is only a part of the embodiment of the present application, but not the all embodiments. Based on the embodiments of the present application, all other embodiments obtained by those skilled in the art without creative labor are within the scope of protection of the present application.

It should be noted that in case that the embodiments of the present application involve directional indications (such as up, down, left, right, front, rear . . . ), then the directional indication is only used to explain the relative position relationship and motion among components in a specific attitude (as shown in the attached figure). In case that the specific attitude changes, the directional indication will change accordingly.

In addition, in case that an embodiment of the present application contains a description referring to "first", "second", etc., the description of "first", "second", etc., shall be used only for the purpose of description and shall not be understood to indicate or imply its relative importance or to indicate implicitly the quantity of the indicated technical features. Thus, a feature defined as "first" or "second" may explicitly or implicitly include at least one of the features. In addition, the technical solutions between embodiments may be combined with each other, but they must be based on the realization of those skilled in the art. When the combination of technical solutions is contradictory or impossible to be realized, it shall be considered that such combination of technical solutions does not exist and is not within the scope of protection required by the present application.

The present application provides a cleaning apparatus. In some embodiments, the cleaning apparatus is a sweeping robot, a floor mopping robot, a sweeping and mopping robot or a window cleaning robot, etc., which is not limited herein.

Figure 2:
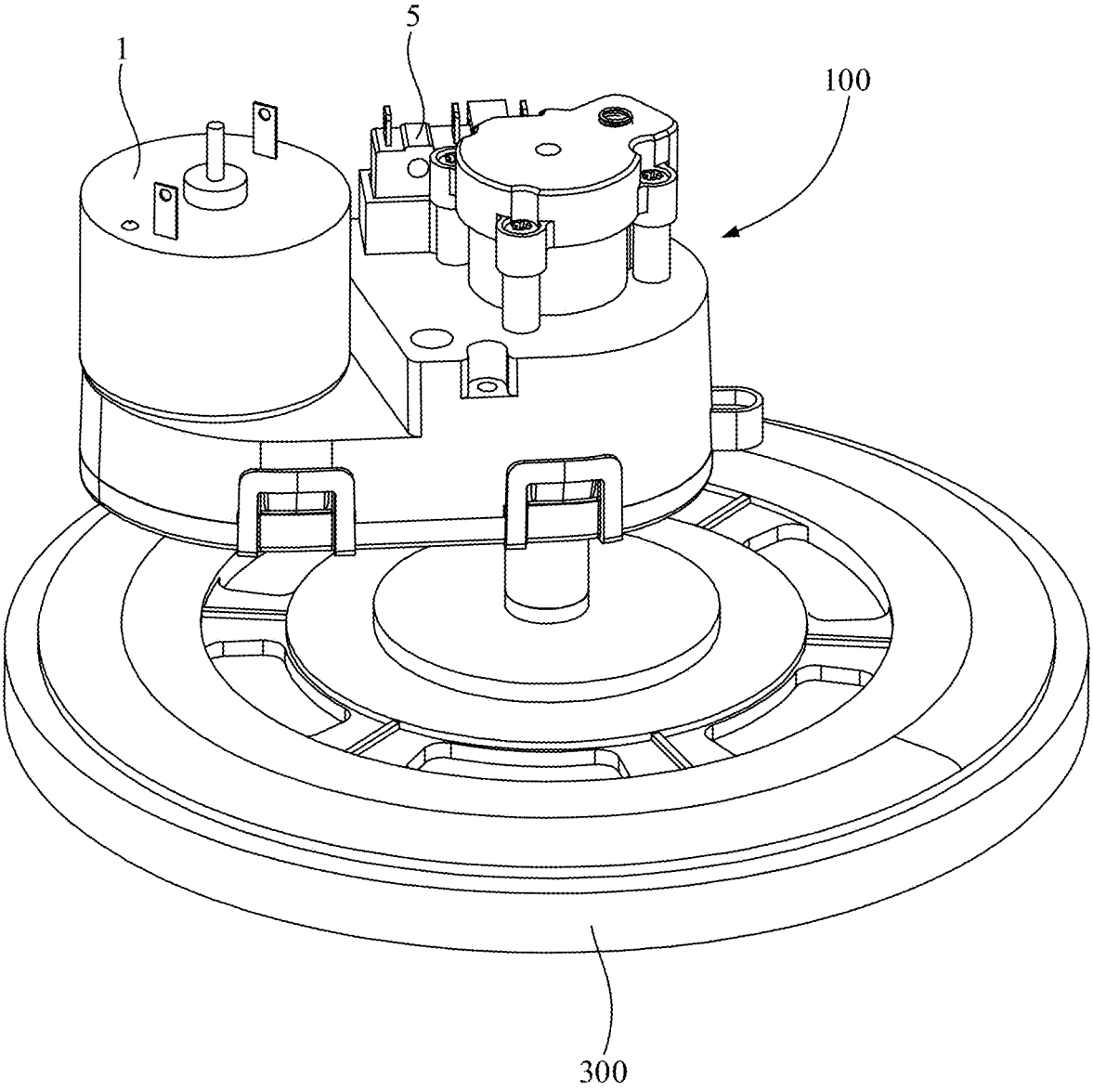
FIG. 2 is a structural schematic view of FIG. 1 where a part of the structure is omitted.

As shown in FIGS. 1 and 2, in the embodiment, the cleaning apparatus includes a machine body 200, a lifting device 100 and a cleaning component 300. When the cleaning apparatus is a sweeping robot, the cleaning component 300 is a floor brush suitable for the sweeping robot; when the cleaning apparatus is a mopping robot, the cleaning component 300 is a mop suitable for the mopping robot, and when the cleaning apparatus is a window cleaning robot, the cleaning component 300 is a cloth or paper cleaning supplies suitable for the window cleaning robot.

The lifting device 100 is mounted on one side of the machine body 200, and the cleaning component 300 is mounted on the mounting portion 21 of the lifting device 100. The lifting device 100 is used to drive the cleaning component 300 to do the lifting movement. It should be noted that when the cleaning apparatus is the sweeping robot or the mopping robot, the lifting device 100 is generally mounted at the bottom of the machine body 200 to drive the cleaning component 300 to move in the height direction of the machine body 200. When the cleaning apparatus is the window cleaning robot, the lifting device 100 is mounted in a front side of the machine body 200 to drive the cleaning component 300 to move in the front and back direction of the machine body 200. When the cleaning apparatus cleans some objects (such as but not limited to beds, sofas, etc.) which are set on the ground at intervals and need to be cleaned at the bottom surface, the lifting device 100 can also be arranged on the top of the machine body 200, which is not limited herein.

In some usage scenarios, when the machine body 200 detects that objects such as carpets and other items are placed in a moving path of the machine body 200 that may interfere with the movement of the cleaning component 300, in order to prevent stains carried by cleaning component 300 from contaminating these objects and ensure the smooth movement of machine body 200, the lifting device 100 can drive the cleaning component 300 to move in the direction adjacent to the machine body 200, so that the cleaning component 300 is separated from these objects.

In other usage scenarios, when the cleaning device completes the cleaning task, the lifting device 100 drives the cleaning device 300 to move closer to the machine body 200 to keep the cleaning device 300 away from the ground in order to prevent the stain on the cleaning device 300 from contaminating the cleaned ground.

The cleaning apparatus with the lifting function of the cleaning component 300 on the market needs to be provided with at least two drivers, one driver is used to drive the cleaning component 300 to rotate for cleaning, and the other one is used to drive the cleaning component to finish the lifting movement, the volume of the cleaning apparatus is increased due to the installation of two drivers, which is not conducive to the cleaning apparatus into a small space for cleaning operation, and the use of two drivers will lead to high manufacturing costs of cleaning apparatus, which is not conducive to improving the competitiveness of cleaning apparatus among similar products.

In order to solve the above problems, the present application provides a lifting device 100.

In embodiments of the present application, as shown in FIG. 2 to FIG. 10, the lifting device 100 includes: a drive motor 1, a rotating shaft 2, a transmission assembly 3 and a traction member 4. In particular, in some embodiments, the lifting device 100 further includes a housing, and the housing is used as a carrier for the drive motor 1, the rotating shaft 2, the transmission assembly 3, the traction member 4 and the switch 5 mentioned below. The housing can be mounted on the machine body 200, the structural shape of the housing can be adjusted according to the actual use requirements, which is not limited herein. In other embodiments, the drive motor 1, the rotating shaft 2, the transmission assembly 3, the traction assembly 4, and the switch 5 mentioned below are mounted directly on the machine body 200, which is not limited herein.

Figure 3:
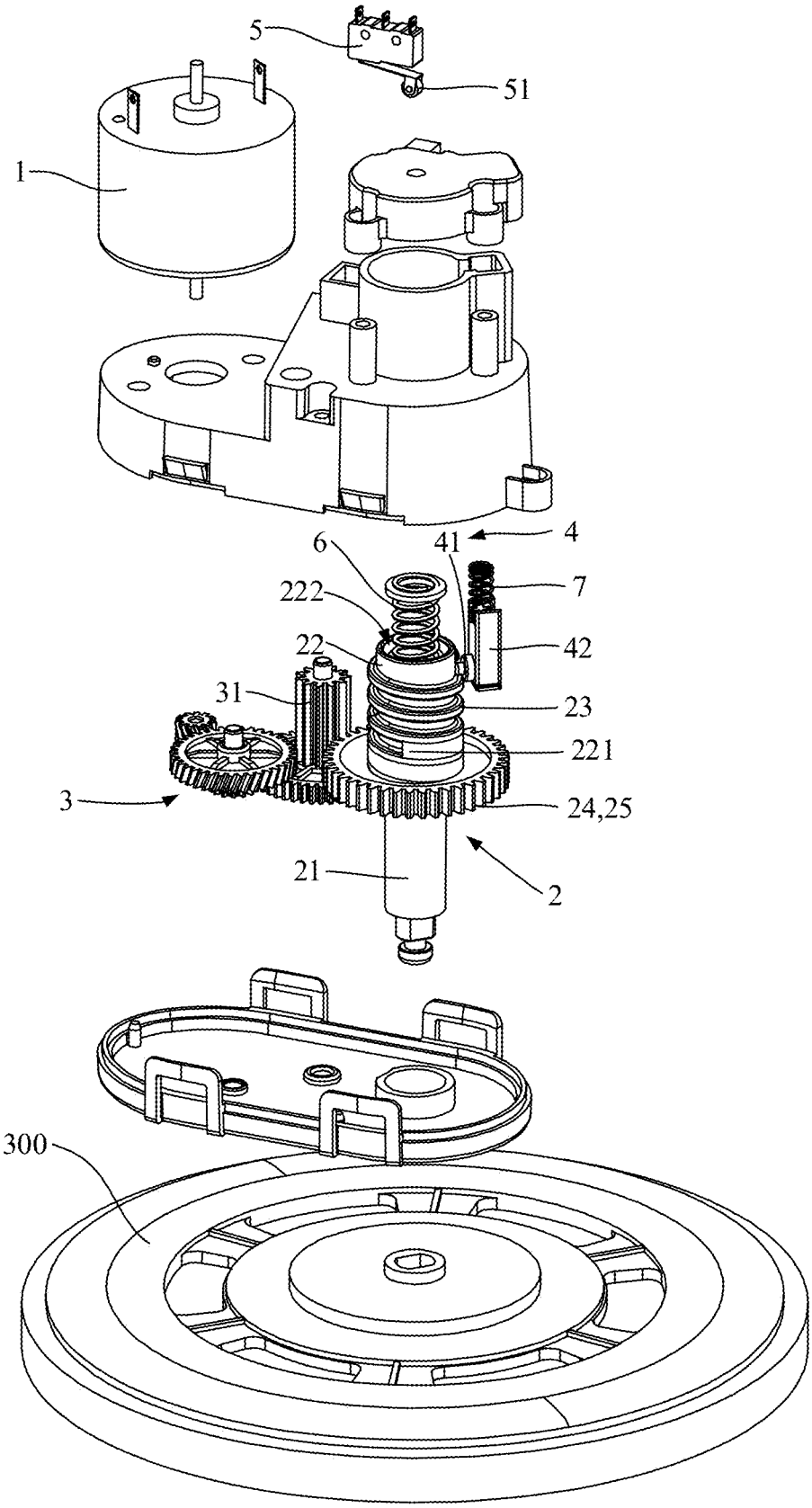
FIG. 3 is an exploded schematic view of FIG. 2.
Figure 4:
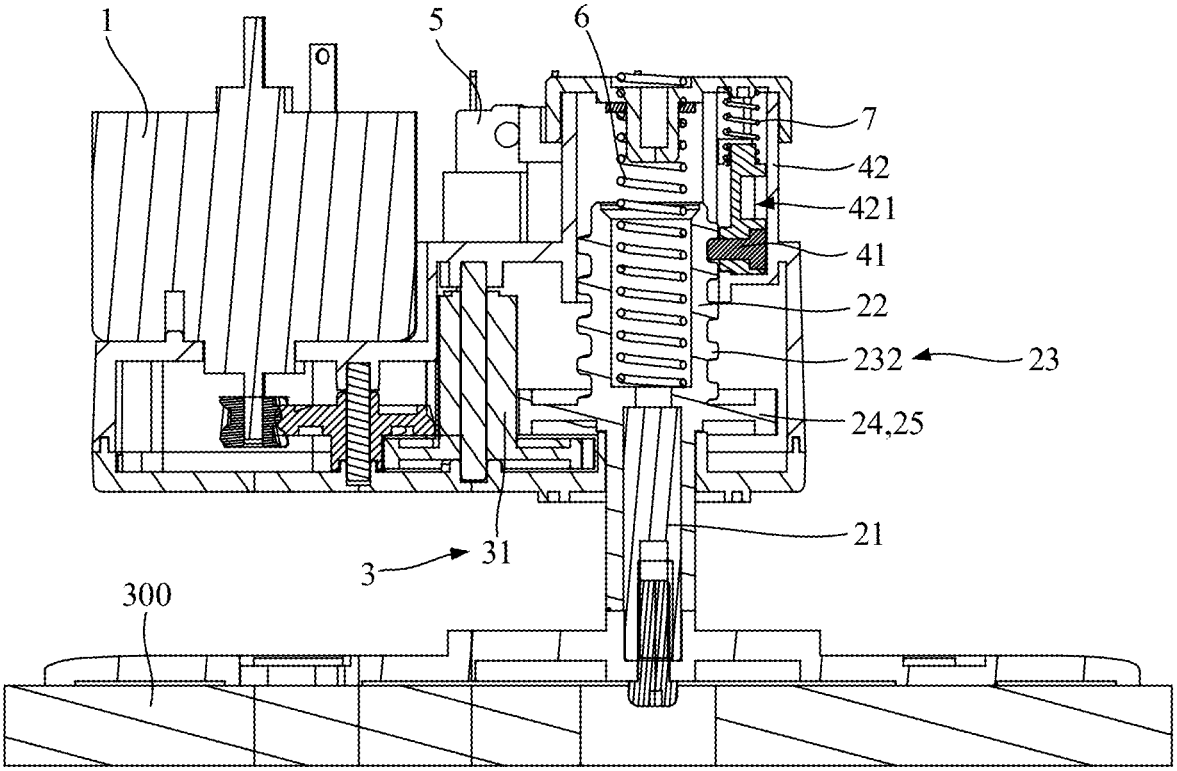
FIG. 4 is a cross-sectional view of an usage state of the structure of FIG. 2 (i.e., a schematic view of the structure after the rotating shaft is rotated in a first rotation direction)
Figure 6:
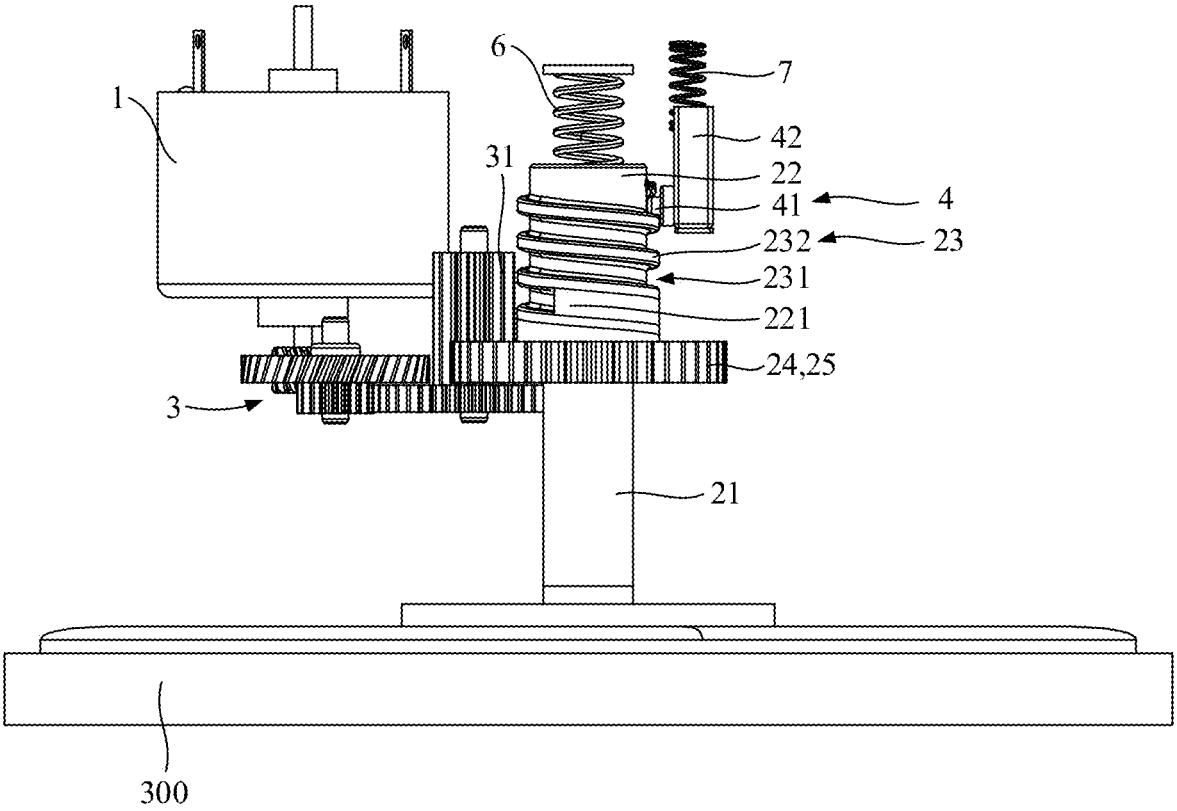
FIG. 6 is a structural schematic view of an usage state of the structure of FIG. 2 (i.e., a schematic view of the structure after the rotating shaft is rotated in a first rotation direction), where a part of the structure is omitted.
Figure 8:
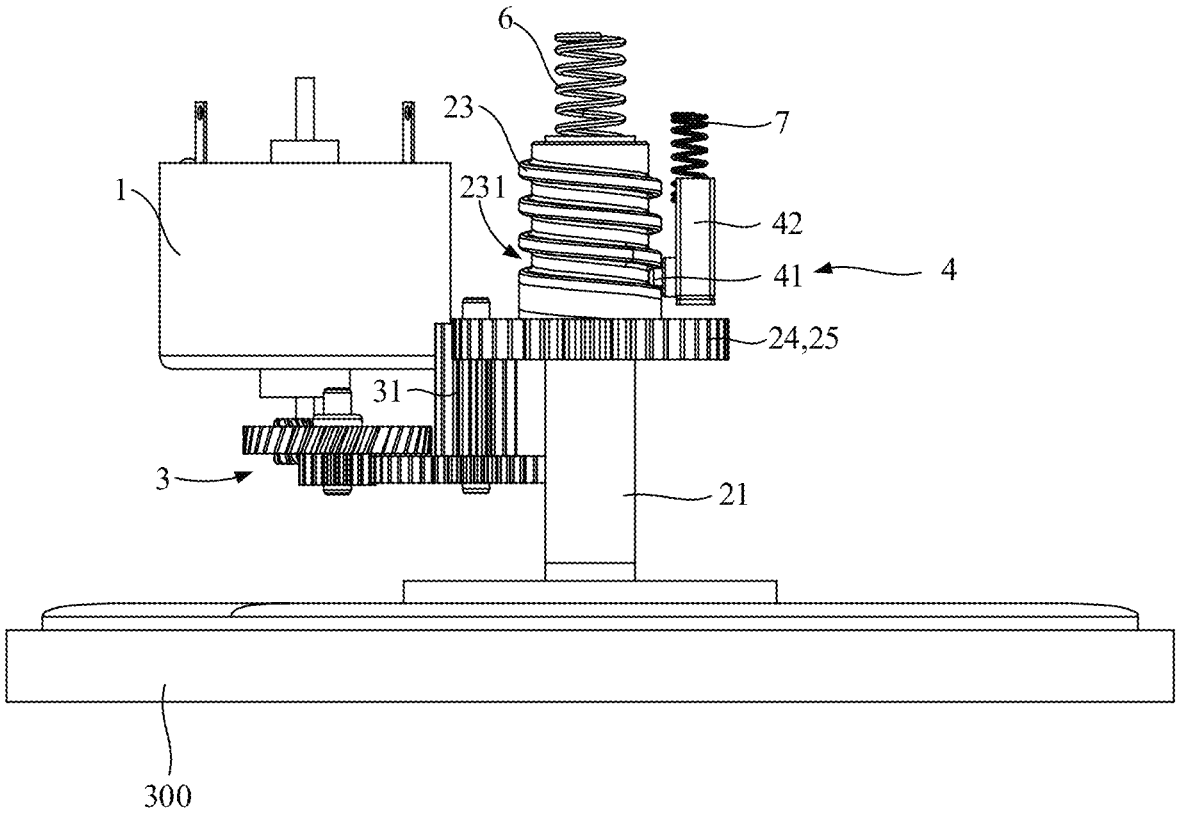
FIG. 8 is a structural schematic view of another usage state of the structure of FIG. 2 (i.e., a schematic view of the structure after the rotating shaft is rotated in a second rotation direction), where a part of the structure is omitted.

As shown in FIGS. 3, 6 and 8, the rotating shaft 2 includes a mounting portion 21 and a lifting drive portion 22 that are connected with each other, and the mounting portion 21 is used to be connected with the cleaning component 300. In particular, in order to facilitate the maintenance and replacement of the cleaning component 300, the mounting portion 21 is detachably connected to the cleaning component 300. During the specific implementation, in some embodiments, as can be seen in FIG. 4, an insertion slot (not identified in FIG. 4) is arranged on the cleaning component 300, and the end of mounting portion 21 is detachably inserted into the insertion slot. In other embodiments, a first magnetic suction member is provided on one of the mounting portion 21 and the cleaning component 300, and a second magnetic suction member magnetically matched with the first magnetic suction member is provided on the other one of the mounting portion 21 and the cleaning component 300. The mounting portion 21 is assembled with the cleaning component 300 through a magnetic connection between the first magnetic suction member and the second magnetic suction member. In yet embodiment, a mechanical claw is arranged at an end of the mounting portion 21 for grabbing the cleaning component 300, so as to grab the cleaning component 300 and drive the cleaning component 300 to move for cleaning. The structure of assembling between the mounting portion 21 and the cleaning component 300 is various, which is not limited herein.

The transmission assembly 3 is respectively connected with the output end of the drive motor 1 and the rotating shaft 2 to transfer the power of the drive motor 1 to the rotating shaft 2. In the specific implementation, the transmission assembly 3 is a gear, a rack or a belt and other parts for realizing transmission between the output end of the drive motor 1 and the rotating shaft 2. The transmission structure is various, it is not enumerated here, the components that can transfer the rotation of the drive motor 1 to the rotating shaft 2 to rotate the rotation shaft 2 are satisfied, which is not limited herein.

The traction member 4 is threaded to the lifting drive portion 22.

Figure 7:
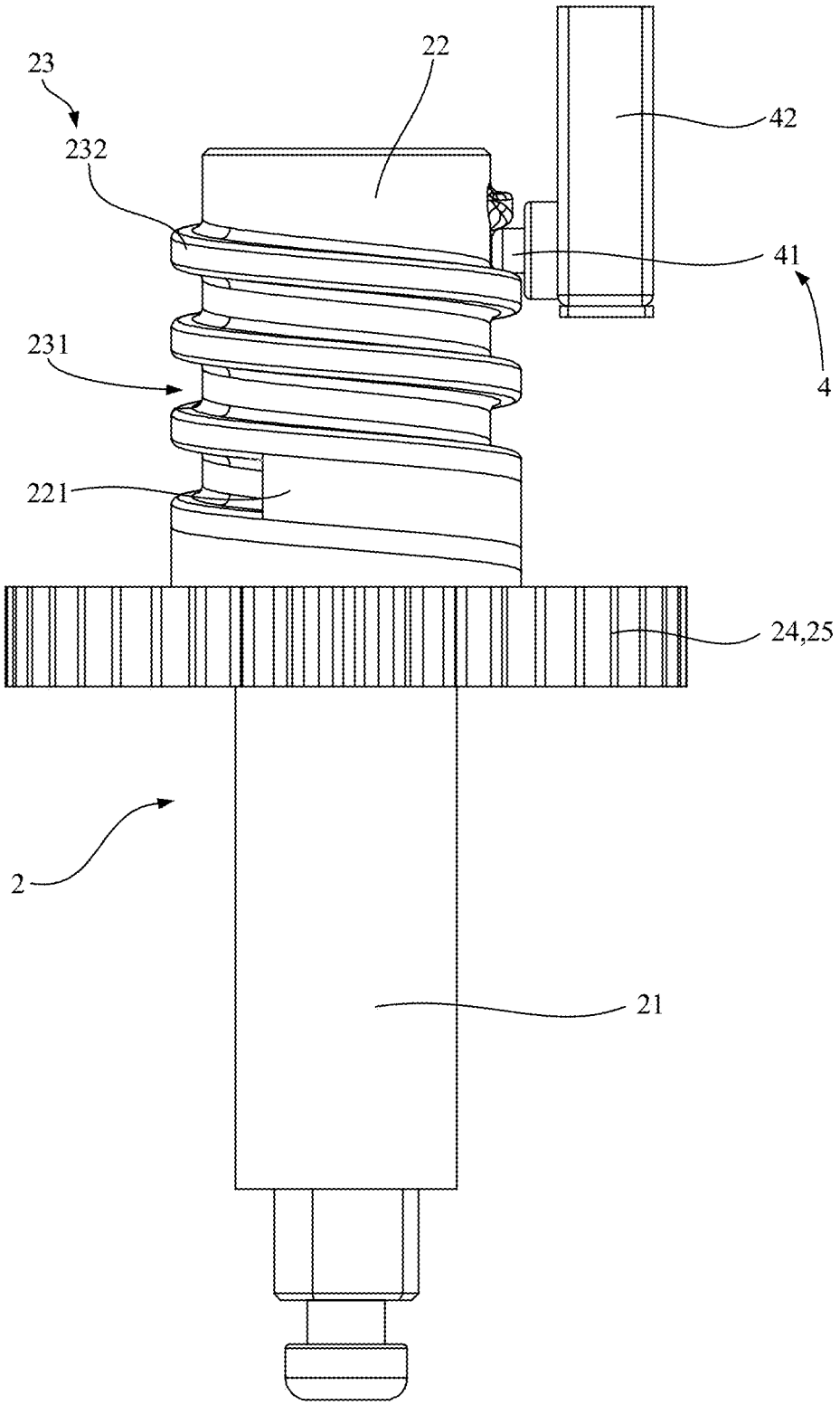
FIG. 7 is an enlarged schematic view of FIG. 6, where a part of the structure is omitted.

In the specific implementation, in some embodiments, the peripheral wall of the lifting drive portion 22 is provided with an external thread extending spirally along its own axis direction (the external thread can be thread 23 as shown in FIG. 7), the traction member 4 includes a cylinder (not shown) sleeved on the lifting drive portion 22, and the inner peripheral wall of the cylinder is provided with an internal thread matching with the external thread. The cylinder is threaded to the lifting drive portion 22 through the match between the internal thread and the external thread.

In other embodiments, a threaded hole (not shown) is provided at one end of the lifting drive portion 22 away from the mounting portion 21, and the traction member 4 includes a threaded post matching with the threaded hole (not shown), the threaded post is threaded to the threaded hole.

In yet embodiment, as shown in FIG. 7, the peripheral wall of the lifting drive portion 22 is provided with thread 23 extending spirally along its own axis direction, and the traction member 4 includes a traction slider 41 arranged on one side of the lifting drive portion 22, and at a part of the structure of the traction slider 41 is slideably arranged in the groove 231 of thread 23. It can be understood that using the method that the traction slider 41 being matched with the thread 23 can simplify the structure of the traction member 4 when comparing with the above two embodiments, such method reduces the material cost of the traction member 4, while conducive to reduce the volume of the lifting device 100, which is conducive to the cleaning apparatus into the narrow space for cleaning operation.

When the rotating shaft 2 is driven by the drive motor 1 along the first rotation direction, the lifting drive portion 22 rotates relative to the traction member 4, and moves in a direction that approaches the mounting portion 21; When the rotating shaft 2 is driven by the drive motor 1 along the second rotation direction opposite to the first rotation direction, the lifting drive portion 22 rotates relative to the traction member 4 and moves along the direction away from the mounting portion 21.

Figure 5:
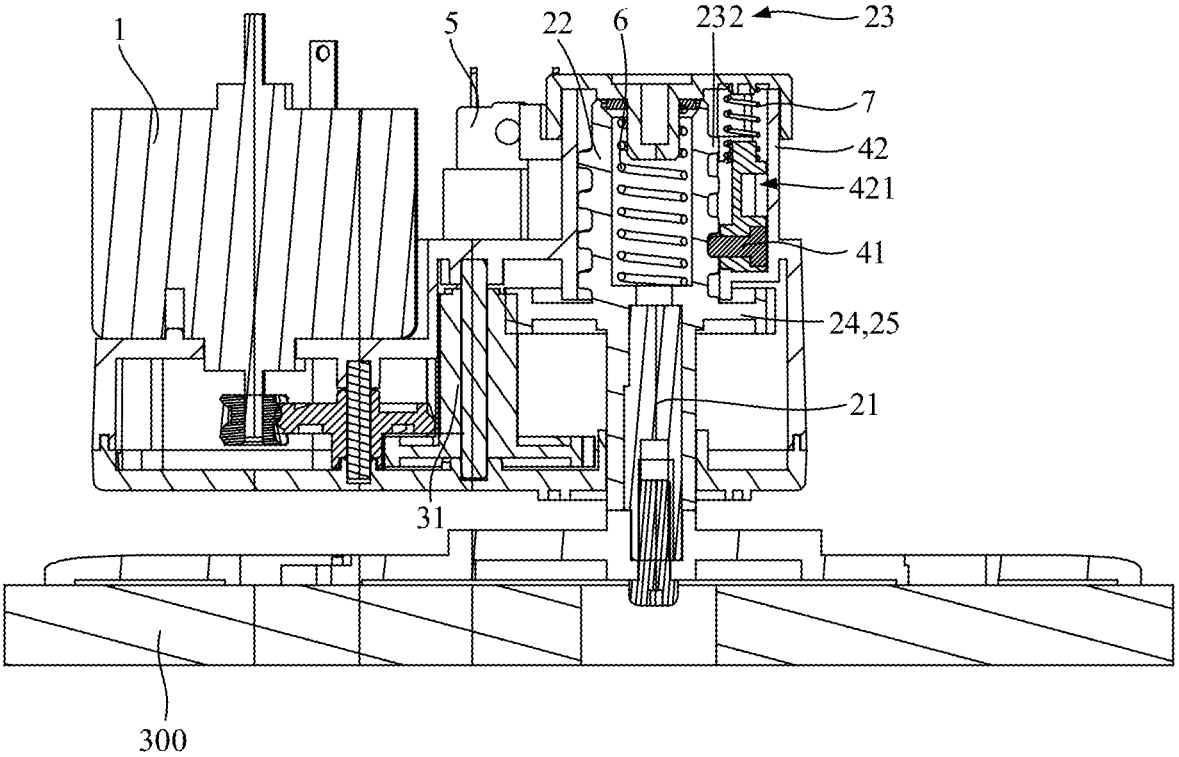
FIG. 5 is a cross-sectional view of another usage state of the structure of FIG. 2 (i.e., a schematic view of the structure after the rotating shaft is rotated in a second rotation direction)

Take the lifting device 100 mounted at the bottom of machine body 200 as an example, as shown in FIG. 3, FIG. 4 and FIG. 5, the traction member 4 does not move, when the rotating shaft 2 rotates along the first rotation direction, that is, when the rotating shaft 2 rotates counterclockwise around its own axis shown in FIG. 3, the rotating shaft 2 does down under the reaction force of traction member 4. In the embodiment where the traction member 4 includes a cylinder or a threaded post, when the rotating shaft 2 is went down to the cleaning component 300 being in contact with the ground, the rotating shaft 2 can be locked with the cylinder or threaded post in a threaded method, and when the cleaning component 300 is rotated to mop the ground, the rotating shaft 2 can be rotated with the cylinder or threaded post. In the embodiment where the traction member 4 includes a traction slider 41, when the rotating shaft 2 is went down to the cleaning component 300 being in contact with the ground and continuously rotating, the traction slider 41 can move back and forth on the last two turns of the screw thread 232 of the thread 23.

When the rotating shaft 2 rotates in the second direction of rotation, that is, when rotating shaft 2 rotates clockwise about its own axis shown in FIG. 3, the rotating shaft 2 goes up under the reaction force of traction member 4. In the above embodiment where the traction member 4 includes a cylinder or a threaded post, when the rotating shaft 2 goes up to the cleaning component 300 being in contact with the ground, at this time, the drive motor 1 can be stopped to prevent the cylinder or thread post from disconnecting with the rotating shaft 2. Similarly, in the above embodiment where traction member 4 includes the traction slider 41, the drive motor 1 can also be stopped when the rotating shaft 2 is went up to the cleaning component 300 being in contact with the ground to prevent the traction slider 41 from slipping out of the end of thread 23 adjacent to the mounting portion 21.

It can be understood that in the lifting device 100 of the present application, the traction member 4 is arranged to be threaded to the rotating shaft 2, so that when the rotating shaft 2 rotates along different rotation directions, the unmovable traction member 4 can exert a reaction force to the rotating shaft 2 through the screw thread at the thread connection to drive the rotating shaft 2 to go up or go down. When the traction member 4 goes down to a height that the cleaning component 300 can perform cleaning, the traction member 4 can be locked with the rotating shaft in a threaded manner, or the traction member 4 moves back and forth on the last two circles of the screw thread on the rotating shaft 2, so as to facilitate the rotating shaft 2 continuous rotation to drive the cleaning component 300 rotating cleaning. Therefore, the design of the present application can realize the rotating cleaning of the cleaning component 300 only by a drive motor to drive the cleaning component 300, and the lifting technical effect of the cleaning component 300 is also realized, which is conducive to reduce the volume of the lifting device 100, and to reduce the volume of cleaning apparatus using the lifting device 100, the reducing the volume of cleaning apparatus is conducive to the cleaning of narrow space and reduce the manufacturing cost of cleaning apparatus.

In order to reduce the friction between the traction slider 41 and a groove wall of the groove 231 and improve the smoothness of sliding of the traction slider 41 in the groove 231, in some embodiments, the part of the traction slider 41 located in the groove 231 of thread 23 is arranged in a cylindrical shape.

Based on the above embodiment where the traction member 4 includes the traction slider 41, an end of groove 231 of thread 23 adjacent to the mounting portion 21 is further provided with a limiting structure 221, and the limiting structure 221 is used to limit the traction slider 41 from sliding out of the groove 231 of the thread 23. When the rotating shaft 2 rotates along the second rotation direction, the traction slider 41 and the limiting structure 221 will approach each other as the lifting drive portion 22 moves away from the mounting portion 21, until the traction slider 41 is abutted against the limiting structure 221. When the traction slider 41 abuts against the limiting structure 221, the cleaning component 300 is moved to a position separated from the ground. After that, in some embodiments, the rotating shaft 2 can be stopped to rotate by stopping the drive motor 1 to save energy. In other embodiments, the drive motor 1 can not be stopped, and the traction slider 41 is movably mounted on the housing, so that the traction slider 41 can rotate with rotating shaft 2 under the push of the limiting structure 221. It can be understood that the movement of traction slider 41 is restricted by the limiting structure 221, which can effectively prevent the interruption of the fit between the traction slider 41 and the thread 23, and it is conducive to ensuring the reliability of product operation.

In the specific implementation, the limiting structure 221 is a limiting wall, a limiting convex edge or a limiting bump, and other structures arranged in groove 231, and which is not limited herein.

In some embodiments, the lifting device 100 further includes a switch 5, the switch 5 is electrically connected to the drive motor 1, and the switch 5 stops the drive motor 1 when triggered. The trigger position of the switch 5 is arranged on the moving path of the rotating shaft 2. When lifting drive portion 22 moves away from mounting portion 21, the rotating shaft 2 can trigger the switch 5. In the embodiment, when the rotating shaft 2 rotates along the second rotation direction, the rotating shaft 2 will drive the cleaning component 300 away from the cleaning surface (such as the ground, glass surface, etc.), when the cleaning component 300 moves to a certain height from the cleaning surface, the switch 5 can be triggered by the rotating shaft 2, and then stop the drive motor 1 to save energy.

In the embodiment where a limiting structure 221 is provided in the groove 231 of the thread 23, as well as the lifting device 100 includes the switch 5, the switch 5 can be triggered before the traction slider 41 abuts against the limiting structure 221, when the traction slider 41 is just abutted against the limiting structure 221.

In the specific implementation, in some embodiments, the switch 5 can be contact switch 5, such as but not limited to a micro switch 5, etc., the rotating shaft 2 includes a triggering portion 24 protruding from the peripheral wall of the lifting drive portion 22, the triggering portion 24 and thread 23 are spaced from each other; the switch 5 is provided with a button 51, the button 51 is arranged on the side of the triggering portion 24 facing away from the mounting portion 21. When the lifting drive portion 22 moves away from mounting portion 21, the triggering portion 24 can press the button 51. It can be understood that the mechanical method to trigger the switch 5 has the advantages of easy implementation and simple control logic. In other embodiments, the switch 5 can also be an induction switch 5, such as but not limited to an infrared induction switch 5, etc., which is not limited herein.

Figure 9:
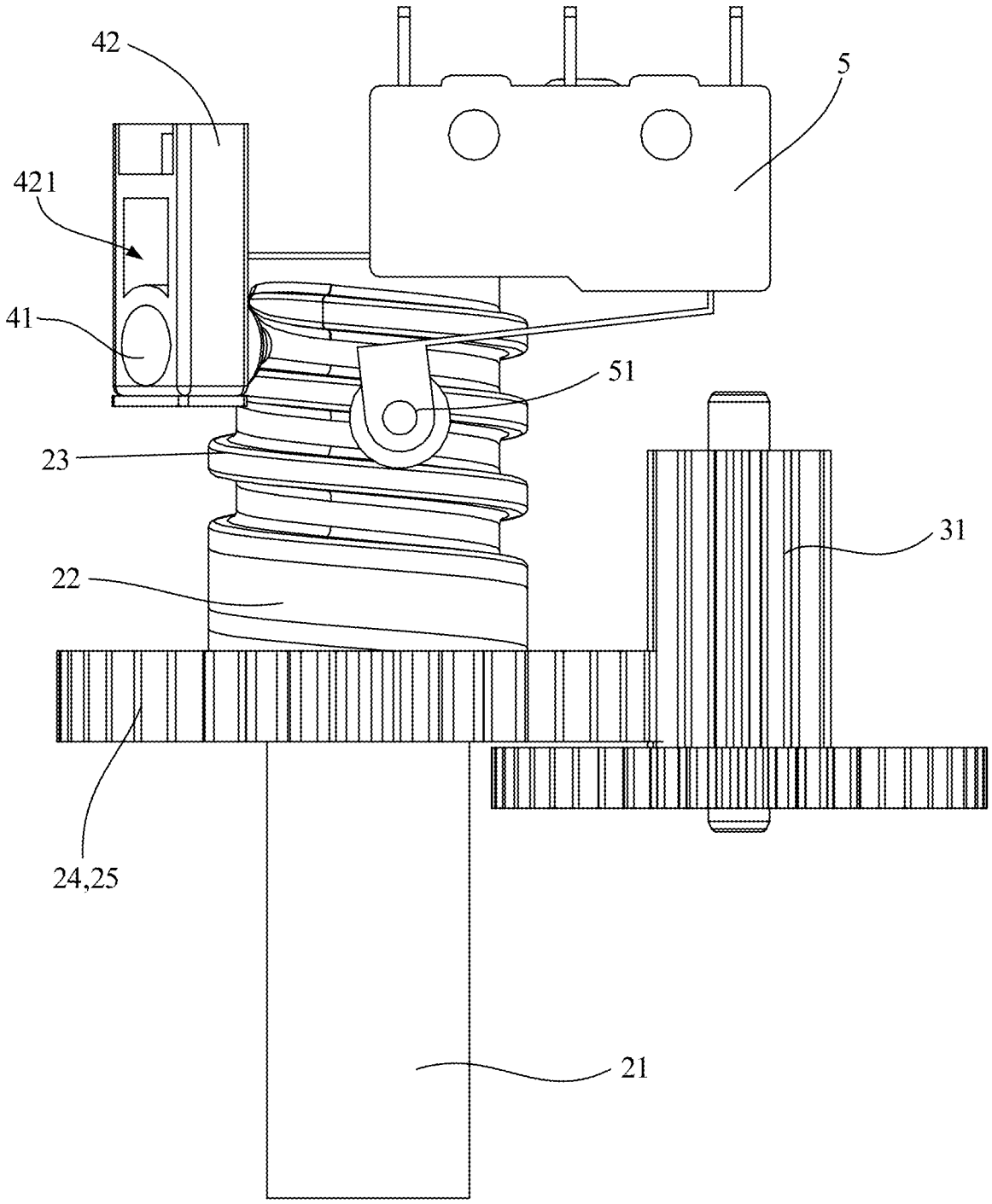
FIG. 9 is a schematic view of an usage state of a switch.
Figure 10:
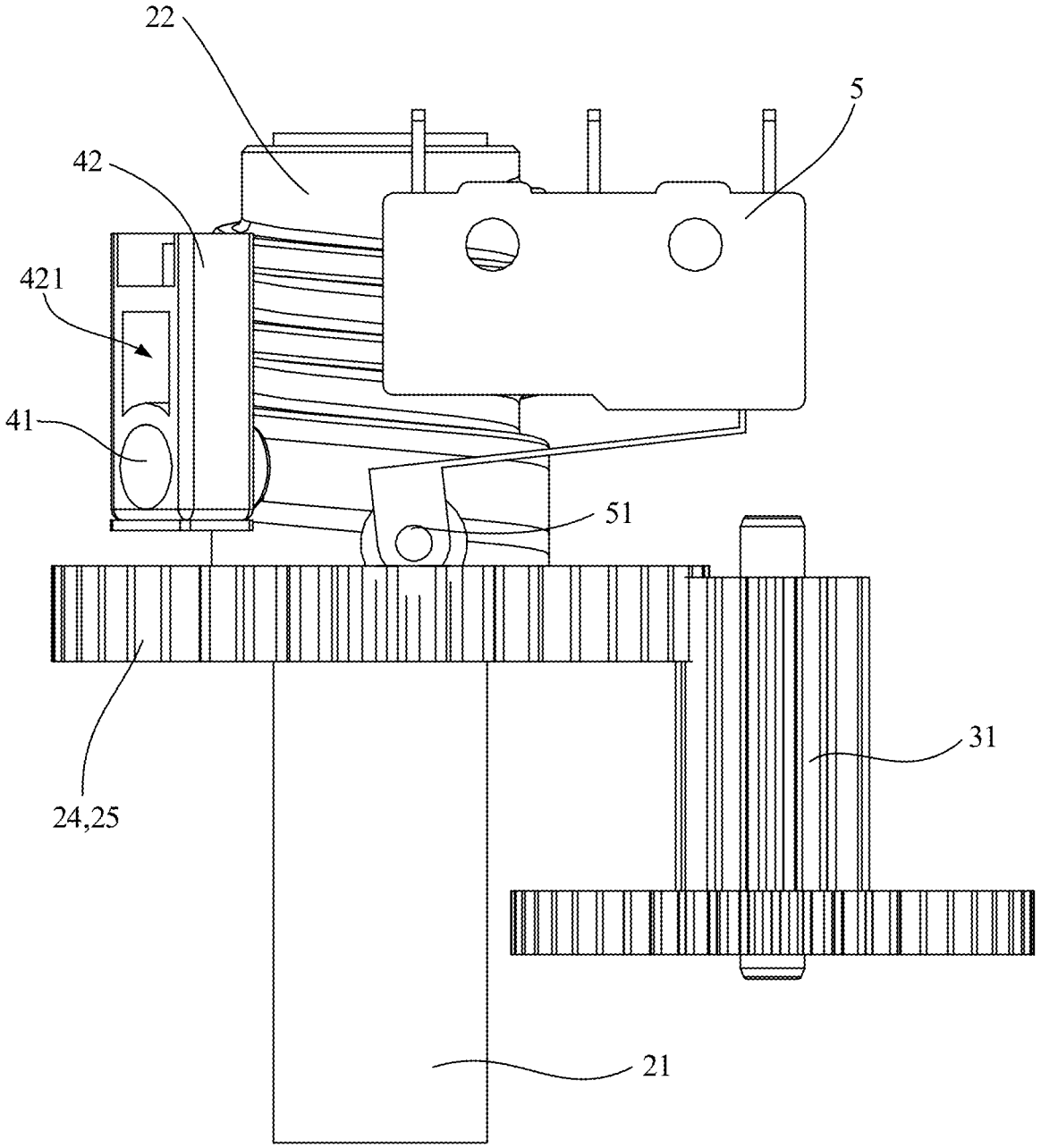
FIG. 10 is a schematic view of another usage state of a switch.

As shown in FIGS. 9 and 10, the triggering portion 24 is a first gear 25 sleeved on the peripheral wall of the lifting drive portion 22; the transmission assembly 3 includes a second gear 31 extending in parallel with the rotating shaft 2, the second gear 31 is connected to the drive motor 1 in a transmission manner, and the second gear 31 is meshed with the first gear 25. It can be understood that the gear meshing transmission manner has the advantages of simple implementation and high transmission reliability. At the same time, the first gear 25 round dual-purpose, that is, the first gear 25 on the one hand is used for meshing transmission with the transmission assembly 3, on the other hand, the first gear 25 is used to trigger the switch 5 with the movement of the lifting drive portion 22, which is conducive to simplifying the structure of the rotating shaft 2 and facilitate the miniaturization of product design.

It is worth noting that, in addition to stopping the drive motor 1 with the switch 5, in some embodiment, a Hall element is arranged at the output end of drive motor 1 to calculate the number of turns of rotating shaft 2 along the second rotation direction, so as to timely stop the drive motor 1 with a preset procedure when the traction pulley is about to separate away from the thread 23.

The lifting device 100 includes a first elastic member 6, the first elastic member 6 is arranged on one side of the lifting drive portion 22 facing away from the mounting portion 21 and connected with the lifting drive portion 22 to provide a drive force to the lifting drive portion 22 when the lifting drive portion 22 moves in the direction that approaches the mounting portion 21. In the specific implementation, the first elastic member 6 can be a spring, a rubber band and other elastic members. It can be understood that, the mounting portion 21 can be quickly adjacent to the cleaning surface under the driving of the first elastic member 6, which is conducive to shorten the time spent for the cleaning component 300 to go down to the cleaning surface.

During the mounting of the first elastic member 6, in some embodiments, an end of the lifting drive portion 22 away from the mounting portion 21 is concavely provided with a mounting groove 222, at least a part of the structure of the first elastic member 6 is arranged in the mounting groove 222, and an end of the first elastic member 6 is elastically abutted against the bottom wall of the mounting groove 222. In particular, the end of first elastic member 6 facing away from the bottom wall of the mounting groove 222 is connected to the housing, or is connected to the machine body 200, which is not limited herein. It can be understood that the cavity in the mounting groove 222 can play a certain constraint role in the expansion and deformation of the first elastic member 6, that is, the first elastic member 6 can only deform in a depth direction of the mounting groove 222 under the constraint of the mounting groove 222, which is conducive to ensuring the reliability of the first elastic member 6. In other embodiments, the end of the lifting drive portion 22 is not provided with the mounting groove 222, and the end of the first elastic member 6 is directly fixed on the end of the lifting drive portion 22, which is not limited herein.

Since the cleaning surface will inevitably have a bumpy situation, when the cleaning component 300 moves from the low-lying place to a flat or steep place, or from the flat or steep place move to the low-lying place, the cleaning component 300 will inevitably shake, and then the rotating shaft 2 and the traction slider 41 are shaken in the housing, so that the rotating shaft 2 and the traction slider 41 are easy to rigid bump with other components (such as the inner wall of the housing). In order to reduce the adverse influence brought by shaking, in some embodiments, the lifting device 100 includes a second elastic member 7, the second elastic member 7 is arranged on a side of the traction member 4 facing away from the mounting portion 21 and is connected with the traction member 4, so that the traction member 4 can be moved in the axis direction of rotating shaft 2. Therefore, when the cleaning component 300 is shaking, the movement amplitude of the rotating shaft 2 in a direction away from the cleaning surface can be effectively reduced under the elastic buffering of the first elastic member 6. Similarly, the movement amplitude of the traction slider 41 in a direction away from the cleaning surface can be effectively reduced under the elastic buffering of the second elastic member 7. Therefore, the bumping between the rotating shaft 2, the traction slider 41 and other components, and the noise caused by the lifting device 100 in the process of shaking is reduced.

Since the traction slider 41 will limit the movement of the rotating shaft 2 away from the direction of the cleaning surface, in case that when the shaking strength has been able to promote the compression deformation of the first elastic member 6, but can not promote the compression deformation of the second elastic member 7, at this time, the rotating shaft 2 is unable to move under the restriction of the traction slider 41, thus causing the cleaning component 300 can not pass through the cleaning surface with a larger slope. In order to avoid the above situation, in the embodiment, the elastic coefficient of the first elastic member 6 is greater than or equal to that of the second elastic member 7. In other embodiments, the elastic coefficient of the first elastic element 6 can also be greater than that of the second elastic element 7, which is not limited herein.

In order to ensure that the second elastic member 7 can expand and deform in the moving direction of the rotating shaft 2, in the embodiment, the traction member 4 includes a mounting housing 42 arranged on one side of the lifting drive portion 22. The mounting housing 42 is formed with a guide groove 421 extending in the same direction as the lifting drive portion 22, and the guide groove 421 is provided with an opening arranged on a side of the mounting housing 42 facing the lifting drive portion 22, the traction slider 41 is slidably mounted in the guide groove 421, and at least a part of the structure of the traction slider 41 is inserted into the groove 231 of the thread 23 through the opening, and at least a part of the structure of the second elastic member 7 is arranged in the guide groove 421 and is connected with the traction slider 41.

The present application further provides a cleaning system, which includes the cleaning apparatus, and the specific structure of the cleaning apparatus can be referred to the above embodiments. Since the cleaning system adopts all the technical solutions of the above embodiments, the cleaning system at least has all the beneficial effects brought by the technical solutions of the above embodiments, which will not be repeated herein.

In the embodiment, the cleaning system can include a service station used in conjunction with the cleaning apparatus, the cleaning apparatus can be parked to the service station, and the service station provides e one or more of charging, cleaning and other services.

The aforementioned embodiments are only preferred embodiments of the present application, and should not be regarded as being limitation to the present application. Any modification, equivalent replacement, improvement, and so on, which are made within the spirit and the principle of the present application, should be included in the protection scope of the present application.

What is claimed is:

1. A lifting device, applied to a cleaning apparatus and configured to drive a cleaning component of the cleaning apparatus to do lifting movement, comprising:

a drive motor;

a rotating shaft, comprising a mounting portion and a lifting drive portion connected to the mounting portion, and the mounting portion being detachably connected to the cleaning component;

a transmission assembly, respectively connected to an output end of the drive motor and the rotating shaft, to transfer a power of the drive motor to the rotating shaft; and a traction member, threaded to the lifting drive portion;

wherein when the rotating shaft is rotated in a first rotation direction driven by the drive motor, the lifting drive portion rotates relative to the traction member and moves in a direction that approaches the mounting portion; and when the rotating shaft is rotated in a second rotation direction opposite to the first rotation direction driven by the drive motor, the lifting drive portion rotates relative to the traction member and moves in a direction away from the mounting portion.

2. The lifting device according to claim 1, wherein a peripheral wall of the lifting drive portion is provided with a thread spirally extending along an axis direction of the lifting drive portion, the traction member comprises a traction slider arranged on a side of the lifting drive portion, and at least a part of a structure of the traction slider is slidably arranged in a groove of the thread.

3. The lifting device according to claim 2, wherein an end of the groove of the thread adjacent to the mounting portion is provided with a limiting structure configured for limiting the traction slider from sliding out of the groove of the thread.

4. The lifting device according to claim 2, wherein the lifting device further comprises a switch electrically connected with the drive motor, and the switch is configured to be triggered to stop the drive motor; and a triggering position of the switch is arranged on a moving path of the rotating shaft, and the rotating shaft is able to trigger the switch when the lifting drive portion moves in the direction away from the mounting portion.

5. The lifting device according to claim 2, wherein a portion of the traction slider located in the groove of the thread is arranged in a cylindrical shape.

6. The lifting device according to claim 1, wherein the lifting device further comprises a first elastic member, the first elastic member is arranged at a side of the lifting drive portion facing away from the mounting portion and is connected to the lifting drive portion, so as to provide a drive force to the lifting drive portion when the lifting drive portion moves in a direction that approaches the mounting portion.

7. The lifting device according to claim 6, wherein the lifting device further comprises a second elastic member, the second elastic member is arranged at a side of the traction member facing away from the mounting portion and is connected to the traction member, so as to enable the traction member to be movable in an axis direction of the rotating shaft.

8. The lifting device according to claim 7, wherein a peripheral wall of the lifting drive portion is provided with a thread spirally extending along an axis direction of the lifting drive portion, the traction member comprises a traction slider arranged on a side of the lifting drive portion, and at least a part of a structure of the traction slider is slidably arranged in a groove of the thread; and the traction member comprises a mounting housing arranged at a side of the lifting drive portion, the mounting housing is provided with a guide groove extending in a same extending direction of the lifting drive portion, the guide groove is arranged to have an opening at a side of the mounting housing facing the lifting drive portion, the traction slider is slidably mounted at the guide groove, and a part of a structure of the traction slider is inserted into the groove of the thread through the opening, and at least a part of a structure of the second elastic member is arranged in the guide groove and connected with the traction slider.

9. The lifting device according to claim 6, wherein an end of the lifting drive portion facing away from the mounting portion is concavely provided with a mounting groove, at least a part of a structure of the first elastic member is arranged in the mounting groove, and an end of the first elastic member is elastically abutted against a bottom wall of the mounting groove.

10. The lifting device according to claim 1, wherein the rotating shaft comprises a triggering portion projecting from the peripheral wall of the lifting drive portion, and the triggering portion and the thread are spaced away from each other; and the lifting device further comprises a switch electrically connected with the drive motor, the switch is a contact switch, the switch is provided with a button, the button is arranged on a side of the triggering portion facing away from the mounting portion, and triggering portion presses the button when the lifting drive portion moves in a direction away from the mounting portion.

11. A cleaning apparatus, comprising:

a machine body;

a lifting device, comprising:

a drive motor;

a rotating shaft, comprising a mounting portion and a lifting drive portion connected to the mounting portion, and the mounting portion being detachably connected to the cleaning component;

a transmission assembly, respectively connected to an output end of the drive motor and the rotating shaft, to transfer a power of the drive motor to the rotating shaft; and a traction member, threaded to the lifting drive portion;

wherein when the rotating shaft is rotated in a first rotation direction driven by the drive motor, the lifting drive portion rotates relative to the traction member and moves in a direction that approaches the mounting portion; and when the rotating shaft is rotated in a second rotation direction opposite to the first rotation direction driven by the drive motor, the lifting drive portion rotates relative to the traction member and moves in a direction away from the mounting portion;

wherein the lifting device being mounted at a side of the machine body; and a cleaning component, mounted on a mounting portion.

12. The cleaning apparatus according to claim 11, wherein a peripheral wall of the lifting drive portion is provided with a thread spirally extending along an axis direction of the lifting drive portion, the traction member comprises a traction slider arranged on a side of the lifting drive portion, and at least a part of a structure of the traction slider is slidably arranged in a groove of the thread.

13. The cleaning apparatus according to claim 12, wherein an end of the groove of the thread adjacent to the mounting portion is provided with a limiting structure configured for limiting the traction slider from sliding out of the groove of the thread.

14. The cleaning apparatus according to claim 12, wherein the lifting device further comprises a switch electrically connected with the drive motor, and the switch is configured to be triggered to stop the drive motor; and a triggering position of the switch is arranged on a moving path of the rotating shaft, and the rotating shaft is able to trigger the switch when the lifting drive portion moves in the direction away from the mounting portion.

15. The cleaning apparatus according to claim 12, wherein a portion of the traction slider located in the groove of the thread is arranged in a cylindrical shape.

16. The cleaning apparatus according to claim 11, wherein the lifting device further comprises a first elastic member, the first elastic member is arranged at a side of the lifting drive portion away from the mounting portion and is connected to the lifting drive portion, so as to provide a drive force to the lifting drive portion when the lifting drive portion moves in a direction that approaches the mounting portion.

17. The cleaning apparatus according to claim 16, wherein the lifting device further comprises a second elastic member, the second elastic member is arranged at a side of the traction member away from the mounting portion and is connected to the traction member, so as to enable the traction member to be movable in an axis direction of the rotating shaft.

18. The cleaning apparatus according to claim 17, wherein a peripheral wall of the lifting drive portion is provided with a thread spirally extending along an axis direction of the lifting drive portion, the traction member comprises a traction slider arranged on a side of the lifting drive portion, and at least a part of a structure of the traction slider is slidably arranged in a groove of the thread; and the traction member comprises a mounting housing arranged at a side of the lifting drive portion, the mounting housing is provided with a guide groove extending in a same extending direction of the lifting drive portion, the guide groove is arranged to have an opening at a side of the mounting housing facing the lifting drive portion, the traction slider is slidably mounted at the guide groove, and a part of a structure of the traction slider is inserted into the groove of the thread through the opening, and at least a part of a structure of the second elastic member is arranged in the guide groove and connected with the traction slider.

19. The cleaning apparatus according to claim 16, wherein an end of the lifting drive portion facing away from the mounting portion is concavely provided with a mounting groove, at least a part of a structure of the first elastic member is arranged in the mounting groove, and an end of the first elastic member is elastically abutted against a bottom wall of the mounting groove.

20. A cleaning system, comprising a cleaning apparatus, wherein the cleaning apparatus comprises: a machine body; and a lifting device, comprising:

a drive motor;

a rotating shaft, comprising a mounting portion and a lifting drive portion connected to the mounting portion, and the mounting portion being with detachably connected to the cleaning component;

a transmission assembly, respectively connected to an output end of the drive motor and the rotating shaft, to transfer a power of the drive motor to the rotating shaft; and a traction member, threaded to the lifting drive portion;

wherein when the rotating shaft is rotated in a first rotation direction driven by the drive motor, the lifting drive portion rotates relative to the traction member and moves in a direction that approaches the mounting portion; and when the rotating shaft is rotated in a second rotation direction opposite to the first rotation direction driven by the drive motor, the lifting drive portion rotates relative to the traction member and moves in a direction away from the mounting portion;

wherein the lifting device being mounted at a side of the machine body; and a cleaning component, mounted on a mounting portion.

* * * * *